United States Patent [19]

Poe et al.

[11] 4,099,751

[45] Jul. 11, 1978

[54] PIN LATCH STRUCTURE

[75] Inventors: Lloyd R. Poe, Long Beach; Frank L. Sawyer, Orange, both of Calif.

[73] Assignee: Hartwell Corporation, Placentia, Calif.

[21] Appl. No.: 735,967

[22] Filed: Oct. 27, 1976

Related U.S. Application Data

[63] Continuation-in-part of Ser. No. 718,066, Aug. 26, 1976, abandoned.

[51] Int. Cl.[2] ..... E05C 1/06

[52] U.S. Cl. ..... 292/139; 292/DIG. 31; 292/DIG. 61

[58] Field of Search ..... 292/34, 36, 48, 82, 292/97, 158, 167, 139, 223, 222, 232, 233, 196, DIG. 31, DIG. 49, DIG. 61

[56] References Cited

U.S. PATENT DOCUMENTS

| | | | |
|---|---|---|---|
| 553,856 | 2/1896 | Johnston et al. | 292/DIG. 49 X |
| 810,918 | 1/1906 | Cunningham | 292/DIG. 49 X |
| 834,097 | 10/1906 | Wray | 292/167 |
| 2,195,542 | 4/1940 | Shaffer et al. | 292/66 |
| 2,469,113 | 5/1949 | Hooker | 292/223 X |
| 2,751,239 | 6/1956 | Nogrette | 292/139 X |
| 2,752,186 | 6/1956 | Morrison | 292/139 |
| 2,944,848 | 7/1960 | Mandolf | 292/DIG. 31 X |
| 3,341,239 | 9/1967 | Wheeler | 292/139 |
| 3,633,953 | 1/1972 | Gley | 292/167 X |
| 3,948,066 | 4/1976 | Solovieff | 292/139 |

FOREIGN PATENT DOCUMENTS

| | | | |
|---|---|---|---|
| 514,551 | 7/1955 | Canada | 292/DIG. 31 |
| 1,559,812 | 11/1969 | Fed. Rep. of Germany | 292/139 |
| 743,297 | 1/1956 | United Kingdom | 292/139 |

*Primary Examiner*—Roy D. Frazier
*Assistant Examiner*—Thomas J. Holko
*Attorney, Agent, or Firm*—Lyon & Lyon

[57] ABSTRACT

A pin latch structure primarily intended for aircraft and arranged to be flush mounted. The latch includes a reciprocable latch pin arranged to be received in a conventional latch socket. The latch pin is retracted or extended by a handle and trigger assembly.

Connected to the latch pin is an overcenter biasing means urging the latch pin into its latch socket and the handle and trigger assembly toward its closed condition when the biasing means is in one direction past center; and urging the latch pin to its retracted position and the handle and trigger assembly to its open position when the biasing means is past center in the opposite direction.

9 Claims, 8 Drawing Figures

PIN LATCH STRUCTURE

This application is a continuation-in-part of a previous application, Ser. No. 718,066, filed Aug. 26, 1976; abandoned Oct. 27,1976.

BACKGROUND AND SUMMARY

Latches, particularly flush latches, that control movement of latch pins for engaging or disengaging latch sockets are commonly used on aircraft. It is essential that such latches be highly dependable.

The primary object of the present invention is to provide means for increasing dependability of pin latch and specifically the primary object is to provide a pin latch structure wherein a biasing force is so applied to a latch pin that for essentially one half of its travel distance it is urged toward its latch socket, and for essentially the other half of its travel distance, it is urged away from the latch socket, the latch pin being connected to a handle and trigger assembly to move the assembly toward its closed position or toward its open position.

A further object is to so arrange the portion of the latch structure utilized as a handle assembly for opening and closing the pin latch to include a manually operable tribber assembly which secures the handle assembly in a flush position and in an initial open position for manual engagement, in both positions the pin latch being secured in its locking position.

DETAILED DESCRIPTION

Figures 1, 2, 3:
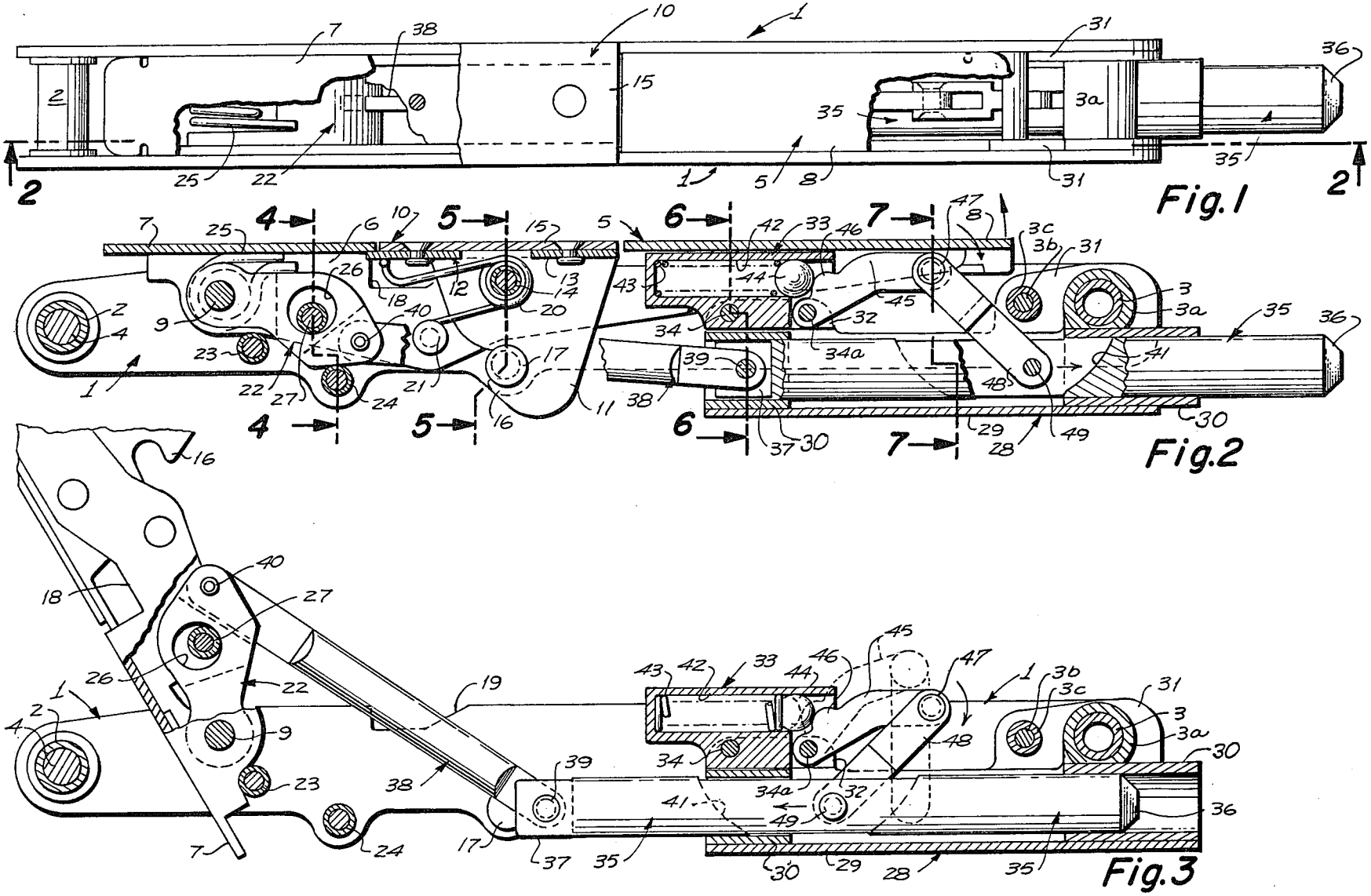
FIG. 1 is a plan view of the pin latch structure in its extended or locking position with portions broken away to expose underlying portions.
FIG. 2 is an longitudinal sectional view taken through 2—2 of FIG. 1 showing the latch pin in its extended position.
FIG. 3 is a similar longitudinal sectional view with portions shown fragmentarily, showing the latch pin in its retracted or unlatched position.
Figure 4:
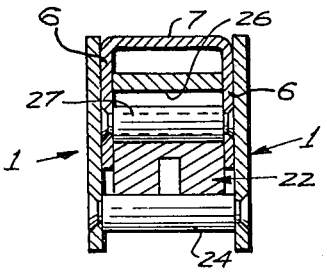
FIGS. 4, 5, 6 and 7 are transverse sectional views taken respectivly through 4—4, 5—5. 6—6 and 7—7 of FIG. 2.
Figure 6:
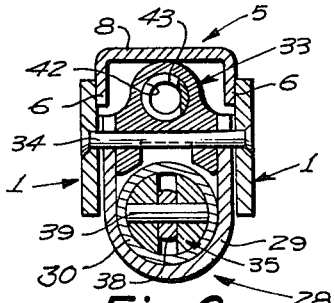
Figure 5:
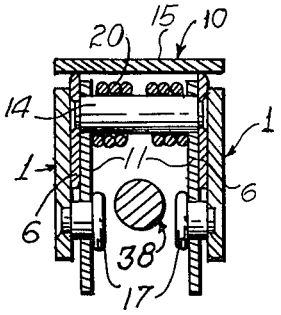
Figure 7:
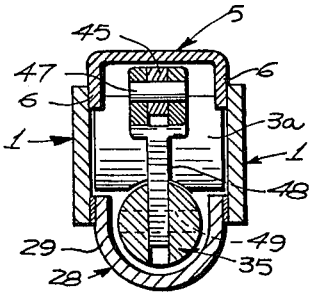

The latch pin structure is intended primarily for use as a flush latch for aircraft, that is, the latch structure is used to secure removable or hinged panels in place and when in its latched position its outer surface is flush with the surrounding surface of the aircraft.

The pin latch structure includes a pair of mounting strips 1 disposed in parallel relation and joined at their extremities by mounting sleeves 2 and 3 which receive shafts 4 for attachment to an adjacent aircraft structure, not shown. Fitted between the mounting strips is a handle assembly 5 having side walls 6 and a pair of cross portions 7 and 8, the handle assembly is channel shaped in the regions of the cross portions 7 and 8 and the cross portions are disposed flush with the surrounding aircraft structure. The side walls 6 fit within and are contiguous to the mounting strips 1, the handle assembly is pivotally connected to the mounting strips near the mounting sleeve 2 by means of a pivot pin 9.

Fitted within the space between the cross portions 7 and 8 is a trigger assembly 10 having side walls 11 and a pair of cross portions 12 and 13, the side walls 11 are continguous to the side walls 6 and the trigger assembly 10 is pivotally connected thereto by means of a pivot pin 14. The cross portions 12 and 13 receive a cover plate 15 normally occupying a position flush with the cross portions 7 and 8.

The side walls 11 are provided below the pivot pin 14 with a pair of hook elements 16 which engage latch pins 17, secured to mounting strips 1. The side walls 6 and the mounting strips 1 are notched, as indicated by 18 and 19 so that the trigger assembly can be pivoted clear of the latch pins 17, a spring 20 surrounds the pivot pin 14, its mid-portion engages the cross portion 12 and its extremities joined to a pair of anchor pins 21 secured to the side walls 6.

The construction thus far described may be considered as conventional. The handle assembly 5 and trigger assembly 10 normally occupy the position shown in FIGS. 1 and 2 in which the cross portions 7 and 8 and cover plate 15 are flush with the surrounding aircraft structure. By manually pivoting the trigger assembly to disengage the elements 16 from the latch pins 17, the handle assembly is free for pivotal movement about the axis of the pivot pin 9, as indicated in FIG. 3.

Carried by the pivot pin 9 is a lever arm 22 disposed between the side walls 6. Inward movement of the lever arm is limited by stop pin 24. The stop pin 23 serves to limit movement of the handle assembly 5, as indicated in FIG. 3. A relatively strong spring 25 surrounds the pivot pin 9 and urges the extremity of the lever arm 22 inward with respect to the handle assembly 5; relative movement of the lever arm with respect to the handle assembly is limited by a transverse bore 26, which loosely receives a transverse pin 27 extending between the side walls 6.

Supported between the mounting strips 1 and underlying the cross portion 8 of the handle assembly 5 is a latch pin mounting assembly 28, which includes a longitudinally extending channel bracket 29 having a pair of spaced guide sleeves 30 attached at the forward and rearward end of the bracket 29. The bracket 29 includes a pair of laterally directed forward mounting lugs 31 and a pair of leterally directed rearward mounting lugs 32 spaced therefrom. Disposed between the rearward mounting lugs 32 is a housing 33 secured to the lugs 32 by cross pins 34 and 34*a*. The assembly 28 is retained between the mounting strips 1 at the forward end by the mounting sleeve 3 and surrounding spacer 3*a*, and also by a second cross pin 3*b* and spacer 3*c* through the mounting lugs 31. At the rearward portion the cross pins 34 and 34*a* extend through the mounting strips 1.

Slidably received in the guide sleeves 30 is a latch pin 35 having a chamfered forward end 36 and a split rearward end 37. The split end receives the forward end of a link member 38 and is pivotally connected thereto by a pivot pin 39.

The opposite or rearward end of the link member 38 is joined to the lever arm 22 by a pivot pin 40. The link member 38 and lever arm 22 are so arranged that when the handle assembly 5 is in its flush position, as shown in FIGS. 1 and 2, the latch pin is in its forward or extended position; then when the handle assembly 5 is pivoted to the position shown in FIG. 3 the latch pin 35 is in its rearward or retracted position.

The latch pin 35 is provided intermediate its ends with a slot 41 which is exposed between the forward and rearward lugs 31 and 32. The housing 33 is provided with a cylindrical socket 42 disposed parallel with the latch pin 35. The socket 42 receives a spring 43 and a ball member 44. The mounting pin 34*a* forms a pivot for a lever 45. The pin 34*a* is disposed under the ball member 44 and the lever 45 is provided with a cam boss 46 engaged by the ball member 44. The lever 45 extends forward under the forward position of the handle assembly 5 and joined by a pivot pin 47 to an overcenter link 48, which extends into the slot 41 provided in the latch pin 35 and is pivotally connected thereto by a cross pin 49.

Operation of the pin latch structure is as follows:

When the latch pin 35 is in its forwardly extended or latching position shown in FIGS. 1 and 2, as well as in the transverse sectional views, FIGS. 4 through 7, the overcenter link 48 exerts a force in a direction tending to extend the latch pin due to the force exerted by the ball member 44 and the lever 45. It should be noted that in this position the extended position of the lever 45 is continguous to the overlying portion 8 of the handle assembly 5 so that the latch pin 35 cannot be retracted unless the handle assembly 5 is pivoted clear.

As the handle is pivoted from the position shown in FIG. 2 to the position shown in FIG. 3 the latch pin 35 is retracted to its disengaged position with respect to the sleeves 30. During this movement the force exerted by the overcenter link 48 is in a direction tending to extend the latch pin 35 and this force is overcome by the manual force applied to the handle assembly 5. At approximately midpoint in the retraction movement, the link 48 reaches an essentially dead center position indicated by dotted lines in FIG. 3. Further movement of the handle assembly 5 moves the link 48 past center so that it exerts a force in a direction tending to further retract the latch pin 35 as it moves from the dotted line position to the solid line position shown in FIG. 3.

When the trigger assembly 10 is unlocked by disengagement of the hooks 16 from the latch pins 17, the spring 25 first causes the handle assembly 5 to rotate a limited distance about the pivot pin 9 from the position shown in FIG. 2 to an intermediate position, not shown. The limited initial relative movement of the handle assembly 5 is permitted by movement of the pin 27 from one side to the opposite side of the transverse bore 26. Movement of the handle assembly 5 under urge of the spring 25 positions the handle so that it can be readily grasped with the hand. This movement is sufficient to permit the operator to grasp the handle assembly 5 and withdraw the latch pin 35 by further movement to the position shown in FIG. 3. The force of the spring 25 is opposed by the force of spring 43 as applied through the ball 44, levers 45 and 48, latch pin 35, link 38 and lever 22. applied thereto by the lever 45, ball member 44 and spring 43, the latch pin tends to occupy either its extreme forward or extreme rearward position within the sleeve; thus, once the handle has been moved far enough to place the lever 48 past center, the handle will tend to move automatically the full distance required to close or free the latch pin 35.

Figure 8:
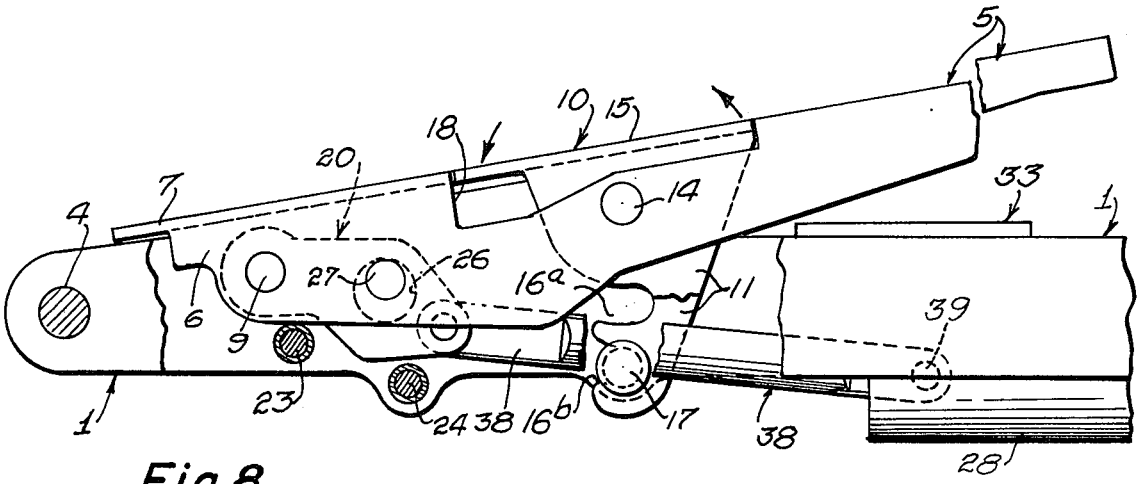
FIG. 8 is a longitudinal side view showing a modified trigger assembly having two sets of hook elements.

Referring to FIG. 8, in this embodiment, the trigger assembly 10 is provided with two sets of hook elements 16*a* and 16*b*. The hook elements 16*a* function in the same manner as the hook elements 16*b*; that is, the hook elements 16*a* secure the handle assembly 5 in its flush position as shown in FIG. 2. The second set of hook elements 16*b* secures the handle assembly in position to be readily grasped manually without releasing the pin latch 35. Such movement of the handle assembly 5, without corresponding pin latch movement, is made possible by the free movement of the handle assembly relative to the pin latch movement permitted by the transverse bore 26 in the lever arm 22 with respect to the pin 27.

With this arrangement, the handle assemblies of various latch structures may be placed in readily accessible positions requiring only that the trigger assemblies 10 be disengaged, which is readily accomplished simultaneously with manual grasping of the handle assemblies 5. Furthermore, with this arrangement, should a handle assembly be accidentally engaged, the trigger assembly 10, being in a flush position, is not likely to be engaged accidentally; thus, the pin latch structure is not released. Also, if the handle assembly is not re-secured in its flush condition prior to flight of the aircraft, the pin latch remains fully secured.

Having fully described our invention, it is to be understood that we are not to be limited to the details herein set forth, but that our invention is of the full scope of the appended claims.

We claim:

1. A latching structure comprising:

a. a mounting means including a guide sleeve;

b. a latch pin axially reciprocable with respect to the guide sleeve between an extended position, an intermediate position and a retracted position;

c. yieldable means interconnecting the mounting means and latch pin operable between the intermediate and extended positions of the latch pin tourge the latch pin toward its extended position and operable between the intermediate and retracted positions of the latch pin to urge the latch pin toward its retracted position;

d. and a manually operated pivotable handle means and linkage means connected to the latch pin for retracting and extending the latch pin;

e. the handle means and linkage means including a manually engagable trigger assembly having two positions, a first position in which the trigger assembly secures the handle means in a flush condition, and a second position in which the trigger assembly secures the handle means in a manually accessible position while the latch pin remains in its latch position.

2. A latching structure as defined in claim 1, wherein:

a. the yieldable means includes a lever pivotally connected to the mounting means, a spring tending to rotate the lever in one direction, and a link extending beteen the lever and the latch pin and movable through an overcenter position to apply the force of the spring in opposite directions to the latch pin.

3. A latching structure as defined in claim 1, wherein:

a. manually operable latch means is provided for securing the handle means in its closed position;

b. and the linkage means includes a loose connection permitting limited free movement of the handle means relative to the latch pin to facilitate, after release of the latch means, initial movement of the handle means from its closed position to enable manual engagement with the handle means for withdrawal of the latch pin.

4. A latching structure as defined in claim 1, wherein:

a. said handle means occupies a closed position when the latch pin is extended, and includes a portion blocking retraction movement of the latch pin from its extended position when the handle means occupies its closed position.

5. A latching structure, comprising:

a. mounting means including a pair of spaced coaxial guide sleeves and a spring socket in essentially parallel reaction with the guide sleeves;
b. a latch pin axially slidable in the guide sleeves, between an extended latching position, a midposition, and a retracted nonlatching position;
c. a spring received in the socket;
d. a lever arm pivotally connected to the mounting means at one side of the socket and including a side extension overlying the open end of the spring socket;
e. a thrust means including a spring in the socket for applying a torquing force on the lever;
f. a link member connecting the lever arm and latch pin, the link member being movable between a position applying a force on the latch pin in one direction and a position applying a force on the latch pin in the other direction as the latch pin moves through its midposition;
g. a manually operated pivotal handle;
h. and a linkage means joining the handle to the latch pin to effect movement of the latch pin between its extended positions.

6. A latching structure as defined in claim 5, wherein:
a. manually operable latch means is provided for securing the handle in its closed position;
b. the linkage means includes a loose connection permitting limited relative movement between the handle and latch pin to facilitate initial movement of the handle from its closed position after release of the latch means to permit manual engagement with the handle for withdrawing the latch pin.

7. The combination with a flush latch structure including a handle assembly pivotable between a flush position and an extreme angular position, a fixed guide sleeve underlying the handle assembly, a latch pin slidable in the sleeve and connected by first linkage means to the handle assembly between an extended position, when the handle assembly is in its flush position, and a retracted position when the handle assembly is in its extreme angular position of an overcenter operating means comprising:
a. a support fixed with respect to the guide sleeve;
b. second linkage means extending between the support means and the latch pin;
c. the second linkage means being movable between a first position, when the latch pin is extended through an intermediate position, a second position when the latch pin is retracted;
d. and yieldable means operable, when the second linkage means is between its first position and its intermediate position, to urge the latch pin toward its extended position and operable, when the second linkage means is between its intermediate position and second position, to urge the latch pin toward its retracted position.

8. The combination as set forth in claim 7, wherein:
a. the second linkage means includes a lever pivotally connected with respect to the guide sleeve, a link pivotally connected to the latch pin, the lever including a cam means positioned to cause reversal of force on the link and the latch pin;
b. the yieldable means is a spring;
c. and the ball member is interposed between the spring and cam means.

9. A latching structure for an aircraft panel adapted to fit in a flush position within a frame having a keeper, said latching structure comprising:
a. a mounting means carried by the panel;
b. latching means carried by the mounting means, the latching means being movable between a position engaging the keeper, and a position disengaged therefrom;
c. a handle assembly connected with the mounting means and the latching means;
d. said handle assembly being pivotable between a position flush with the panel and an initial angularly projecting position for manual engagement wherein, in both positions, the latching means is held in its keeper engaging position; and a final angularly projecting position wherein the latching means is disengaged from its keeper;
e. and a trigger assembly carried by the handle assembly and having first latching elements securable with respect to the mounting means, when said handle assembly is in its flush position, and second latching elements, also securable with respect to the mounting means, when said handle assembly is in its initial angularly projecting position;
f. said trigger assembly normally occupying a flush position with respect to said handle assembly and manually movable to free said handle assembly for movement toward its final position to free the latching means from its keeper;
g. said trigger assembly including yieldable means for retaining said trigger assembly in position to secure said handle assembly in either its flush position or initial angular position.

* * * * *